United States Patent [19]

D'Antonio et al.

[11] 3,998,415

[45] Dec. 21, 1976

[54] APPARATUS FOR HOLDING A BAG OPEN

[76] Inventors: Joseph V. D'Antonio, 106 Mancil Road, Media, Pa. 19063; Lawrence E. D'Antonio, 1000 Clifton Ave., Collingdale, Pa. 19023; Nicholas F. D'Antonio, 7695 Admiral Drive, Liverpool, N.Y. 13088; Richard L. Bates, 125 Hillside Way, Camillus, N.Y. 13031

[22] Filed: Mar. 6, 1975

[21] Appl. No.: 556,094

[52] U.S. Cl. ..... 248/101; 15/257.1

[51] Int. Cl.[2] ..... B65B 67/12

[58] Field of Search ..... 248/99, 101, 100; 150/2, 5; 15/257.1; 141/316

[56] References Cited

UNITED STATES PATENTS

| | | | |
|---|---|---|---|
| 991,081 | 5/1911 | Parr | 248/99 |
| 1,031,033 | 7/1912 | Williams | 150/2 |
| 1,211,278 | 1/1917 | Blum | 141/316 UX |
| 1,214,761 | 2/1917 | Craig | 248/99 |
| 1,650,447 | 11/1927 | Heyer | 248/99 |
| 2,527,746 | 10/1950 | Lawrence | 150/2 |
| 3,697,030 | 10/1972 | Schultze | 248/101 |
| 3,744,081 | 7/1973 | Miller | 248/101 X |
| 3,754,785 | 8/1973 | Anderson | 248/99 X |
| 3,796,402 | 3/1974 | Trotta | 248/101 X |
| 3,818,956 | 6/1974 | Chamberlain | 141/316 |

FOREIGN PATENTS OR APPLICATIONS

| | | | |
|---|---|---|---|
| 169,276 | 11/1959 | Sweden | 248/99 |
| 968,738 | 9/1964 | United Kingdom | 248/101 |

*Primary Examiner*—Roy D. Frazier
*Assistant Examiner*—Rodney H. Bonck
*Attorney, Agent, or Firm*—D. Peter Hochberg

[57] ABSTRACT

Apparatus for holding a bag open comprising an arch, a pair of retaining members for receiving the ends of the arch and holding the arch in a vertical position, means for securing a part of the periphery of the open end of a bag to the arch, and a base member for controlling the separation between the retaining members and for holding another part of the periphery of the bag against the ground.

4 Claims, 6 Drawing Figures

APPARATUS FOR HOLDING A BAG OPEN

BACKGROUND OF THE INVENTION

1. Field of the Invention

The present invention relates to apparatus for holding collapsible containers such as bags open so that material can be put into the container.

2. Description of the Prior Art

Collapsible containers such as paper, cloth and plastic bags have been in widespread use for a long time. In order to put material in such containers, it is the usual procedure to place the bag in the vertical position with its open end upwardly disposed and to somehow hold the bag open to render its interior accessible. In the case of bags fabricated from more flexible materials such as thin paper and polyethylene plastic, a person must have some assistance to hold the bag open if he is to be able to put material into it. Thus, he must have the aid of another person who can hold the bag open or a mechanical helper. Devices of the latter type are known and include horizontally positioned hoops to which the periphery of the bag can be attached and open-ended cylinders against which the inner surface of the bag is engaged. In order to put material into the bag, the material must generally be transported from the surface on which it is located and dropped into the bag. In the case of refuse from a floor or leaves from a lawn, these materials must be lifted from the ground and carried to a position above the open bag, and then released.

Summary of the Invention

An object of the present invention is to provide means for facilitating the putting of material into a collapsible container such as a bag.

Another object of the invention is to provide means for holding a bag open so that material can be transported directly into the bag from a surface on which the material is disposed.

Still another object of the invention is to provide apparatus of the preceeding type to which a bag can be easily attached so that material can be put into it.

Another, more particular, object of the invention is to provide apparatus for holding open a bag to enable material from a surface such as a floor or a lawn to be directed directly into the bag by a broom, rake or the like.

A further object is to provide apparatus as described above which can hold open bags of different sizes.

Yet another object is to provide apparatus of the foregoing types which is economical to manufacture and easy to use.

Other objects will be apparent from the description to follow and from the appended claims.

Description of the Preferred Embodiment

The embodiment of the invention described below is particularly useful for holding open a large bag for the purpose of receiving leaves and other debris raked from the surface of a lawn. The embodiment includes arch means in the form of a generally semicircular arch or flexible straight member bendable into the shape of an arch, a holding means comprising a set of retaining members for regulating the size of the arch and for holding the apparatus transverse to the ground, securing means such as a plurality of clips for holding a part of the periphery of the open end of the bag to the arch, and base means in the form of a base member for controlling the separation between the retaining members and for holding the part of the periphery of the bag opposite the arch flat adjacent the ground.

Figure 1:
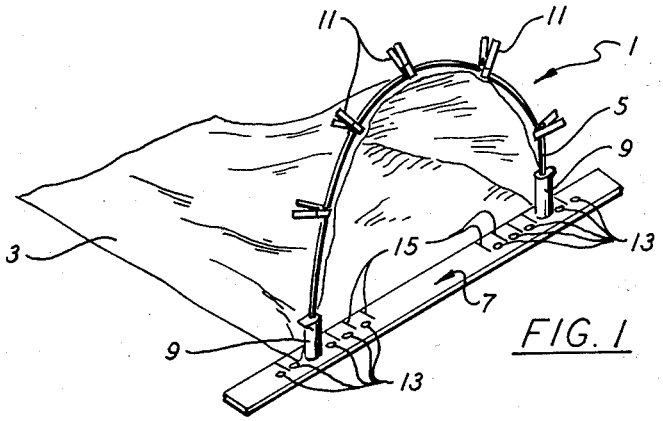
FIG. 1 shows an embodiment of the invention in perspective.

Referring now to the drawings, there is shown in FIG. 1 an apparatus for holding a polyethylene bag 3 open. Apparatus 1 includes an arch 5, a base member 7, a pair of retaining members 9, and a set of clips 11. Arch 5 can be a resilient elongate member which is either straight or curved in a generally U-shape in its unstressed condition. Base member 7 is a flat member whose length should be longer than the diameter of the widest bag apparatus 1 is intended to accommodate. A plurality of pairs of holes 13 are located in rows on opposite sides of the center of member 7, and are dimensioned to receive retaining members 9. Extending inwardly from an edge of a long side of member 7 are a series of slits 15 for receiving portions of bag 3 as described below.

Figure 2:
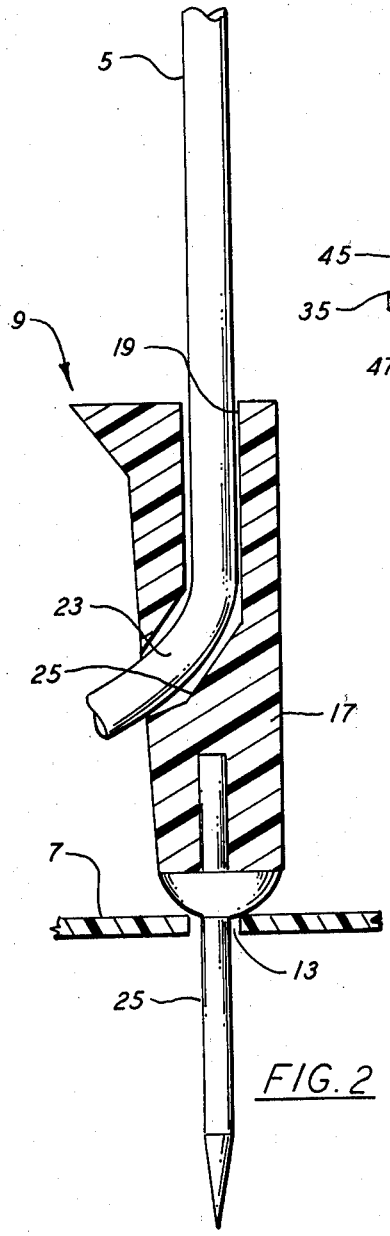
FIG. 2 is a partial cross-sectional detail of a part of the apparatus shown in FIG. 1 used for attaching parts of the apparatus together and for securing the apparatus to the ground.

Arch 5 is positioned relative to base member 7 by means of retaining members 9, which additionally hold apparatus 1 fast in the ground. Each retaining member 9, shown most clearly in FIG. 2, includes an upper portion 17 which can be made of molded plastic, and each upper portion 17 in turn has a channel 19 for receiving and releasably retaining the respective end portions of arch 5. Channels 19 and the ends of arch 5 can be shaped as shown at 21 and 23 respectively to help retain the arch 5 in retaining members 9.

A spike 25 is fixed in portion 17 of retaining member 9, such as by being molded in place or by being screwed or driven into portion 17. Retaining members 9 function to hold apparatus 1 fast on the ground when the spikes 25 are inserted through corresponding pairs of holes 13 on opposite sides of the center of base member 7, and into the ground. Since retaining members 7 also secure the ends of arch 5 to base member 7, the pair of corresponding holes 13 in which retaining members 9 are inserted determine the diameter (or equivalent dimension indicative of the size of the bag opening) of bag 3 which apparatus 1 is adjusted to hold open. Apparatus 1 as shown is adjustable to receive many sizes of bags 3. Apparatus 1 is adjusted to accept larger bags by selecting more widely separated hole pairs in base member 7 to receive retaining members 9.

Figure 3:
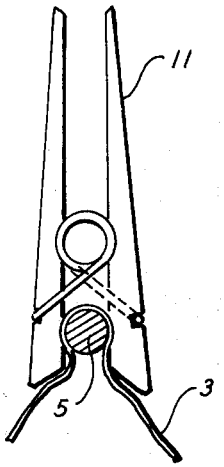
FIG. 3 is a detail side view of the means for securing a bag to the apparatus shown in FIG. 1.

A set of clips 11, which can be ordinary clothes pins, are provided for attaching bag 3 to arch 5. In order to secure the periphery of bag 3 to arch 5, a substantial part of the periphery of the bag at the bag opening is placed over arch 5, and the clips are used to hold the bag against arch 5 as shown in FIG. 3. In order to hold the bag entirely open, the part of the bag periphery extending between the ends of arch 5 is slipped into slits 15 in base member 7 near the holes into which retaining members 9 are disposed so that the rest of the bag periphery is located beneath base member 7, whereby that part of the bag is held against the ground. After the bag 3 is thus attached to apparatus 1, an open mouth to the interior of the bag is presented at ground level, and material can easily be directed therethrough into the bag.

When apparatus 1 is to be used on a hard surface such as a floor or street, an alternate retaining member 9 should be used wherein each spike 25 is dispensed with. Thus, a spikeless retaining member could be used and the person using the apparatus could stand on the portions of base member 7 extending beyond the retaining members to hold it in place. Also, the retaining member could be replaced by a heavy member which would be attached to or integral with portion 17 of retaining member 9. The weight of the alternate retaining members would serve to hold base member 7, and apparatus 1, in place. The alternate retaining members should be configured to enter (but not extend far through) holes 13.

Figure 5:
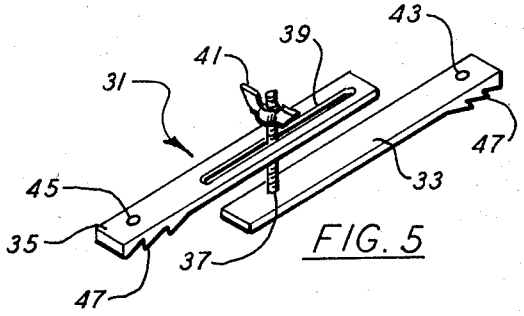
FIG. 5 is a perspective view of a modified base member for use in the inventive apparatus.

FIG. 5 shows a modified form of base member which can be used with apparatus 1. The modified base member is characterized by being expandable so as to accommodate different sizes of arches and bags, and to determine the amount by which any particular arch is expanded. The modified base member is designated by the numeral 31. Base member 31 includes overlapping sections 33 and 35, and section 35 is adapted to slide along a portion of the length of section 33. A post 37 extends vertically upward from section 33 through a longitudinal slot 39 located in section 35. Post 39 is threaded and has located thereon a wing nut 41 which can be screwed down to lock section 35 in place on section 33. The length of slot 39 determines the distance through which section 35 can be moved relative to section 33. Sections 33 and 35 include a pair of holes 43 and 45, respectively, for receiving retaining members 9 which in turn receive the ends of arch 5 as explained earlier. To use base member 31, section 35 is placed over section 33 so that post 37 extends through slot 39. Retaining members 9 are inserted through holes 43 and 45 and sections 33 and 35 are separated to expand the length of base member 31 by the desired amount. Wing nut 41 is then tightened to clamp sections 35 and 33 together and spikes 25 are driven into the ground.

Base member 31 is but one example of an expandable base member. The base member could include means for biasing the moveable sections outwardly for the purpose of holding the arch in place (in the device shown in FIG. 5, the arch itself could be considered such a spring biasing means). In order to remove an arch from such a base member, the moveable sections should be contracted so that the retaining members can be withdrawn from the holes. Another type of expandable base member could comprise a generally planar member whose central portion would be hinged, the object being to raise the hinged central portion so as to draw the opposing end portions of the base member together to shorten the overall length of the base member.

In order to increase the holding power of base member 31 (or any other base member used in apparatus 1), the surface of the base member which contacts the ground can be provided with an appropriate construction or contour such as treads 47 shown on the underside of sections 33 and 35. Other types of surface constructions for holding the base member still on the ground could include spikes, a rough or textured surface, suction cups if the device is to be used on a smooth surface, etc.

Figure 6:
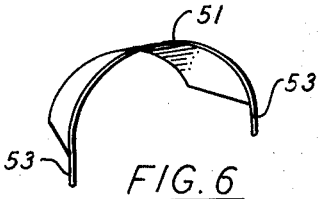
FIG. 6 depicts in perspective a modified arch for use in the apparatus shown in FIG. 1.
Figure 4:
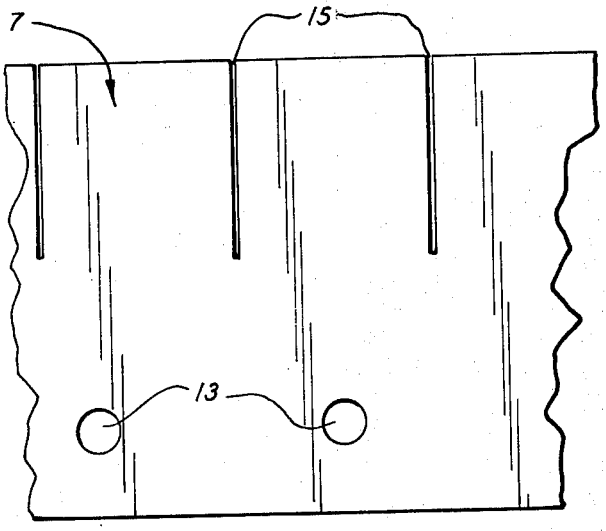
FIG. 4 is a detail plan view of part of the base portion of the apparatus of FIG. 1.

A modified arch is depicted in FIG. 6 and is designated by the numeral 51. Arch 51 has a depth of diminishing diameter — i.e. it is somewhat funnel shaped (although it does not have a closed surface). The function of arch 51 is to guide or funnel material into bag 3. To use arch 51, the bag is slid onto the narrow portion of the arch and across the wide portion thereof. A pair of opposing pegs 53 are provided for insertion into retaining members 9.

Various modifications to the embodiment described above are within the scope of the invention. The shape of arch 5 need not be a part of a circle, and should generally be in conformity with the shape of the opening of the container which the apparatus is to accommodate. The clips can be of any type, and could be dispensed with entirely if the periphery of the bag opening were provided with appropriate tie strings, snaps, or the like.

The devices for holding the bag on the arch can be assisted in their function or dispensed with, if the arch bears against the bag periphery with sufficient force to hold the bag on the arch. This could be accomplished if the bag material can be stretched sufficiently such as to its yield point, and the bag diameter is slightly smaller than the equivalent arch dimension when the bag is in its unstressed condition. In this case, the bag could be stretched and slid over the arch to secure it thereon.

The base member can be rigid or flexible but should conform to the shape of the surface on which it is placed. Slits 15 can be replaced by any means suitable for holding the base of the bag opening adjacent the ground surface, such as a lip for extending partly into the bag. The retaining members should be selected according to the environment in which the apparatus is to be used. The retaining members shown serve the dual functions of holding the apparatus in place and receiving the end of the arch. Separate members for serving these functions could be used instead of the described retaining members. Other means could be employed for holding the ends of the arch in the retaining members instead of the curved conduits 23, such as set screws, clips, means for contracting the interior walls of the retaining members against the arch, and the like. It is also within the scope of the invention to dispense with the retaining members (as where the operator stands on the base member to hold the apparatus in place), and to fasten the ends of the arch in the ground directly (in the latter arrangement the arch ends would themselves be the holding means). The retaining members have been described as operating to hold the arch in a vertical position. Although this is the expected arrangement, occasions may arise which due to the shape of the bag or the ground surface, some other position transverse to the ground may be more suitable.

The invention described above fulfills the objects of the invention. The preferred embodiment is economical and practicable to manufacture, and is easy to use.

The invention has been described in detail with particular reference to the preferred embodiment thereof, but it will be understood that variations and modifications within the spirit and scope of the invention may occur to those skilled in the art to which the invention pertains.

We claim.

1. Apparatus for holding open in a generally vertical position, the mouth of an open-ended collapsible container horizontally disposed on the ground, said apparatus comprising:

curvilinear, flexible arch means dimensioned to have attached thereto a part of the periphery of the open end of the collapsible container, said arch means having generally opposing end portions;

securing means for securing said part of the periphery of the open end of the collapsible container to said arch means;

holding means for receiving the end portions of said arch means and base means for pressing the part of the periphery of the open end of the collapsible container extending directly between the end portions of said arch means against the ground, said base means including a plurality of spaced holes for selectively receiving said holding means to position said arch means in a generally vertical plane relative to the ground, wherein the holes selected for receiving said holding means establish the shape of said arch means; and position said end portions relative to said base means.

2. Apparatus for holding open in a generally vertical position, the mouth of an open-ended collapsible container horizontally disposed on the ground, said apparatus comprising:

curvilinear, flexible arch means dimensioned to have attached thereto a part of the periphery of the open end of the collapsible container, said arch means having generally opposing end portions and a generally conical surface section constructed to funnel matter entering said apparatus into the container attached thereto;

securing means for securing said part of the periphery of the open end of the collapsible container to said arch means; and base means for pressing the part of the periphery of the open end of the collapsible container extending directly between the end portions of said arch means against the ground, said base means including a plurality of spaced holes for selectively receiving said end portions to position said arch means in a generally vertical plane relative to the ground, wherein the holes selected for receiving said end portions establish the shape of the arch means.

3. Apparatus for holding open in a generally vertical position, the mouth of an open-ended collapsible container horizontally disposed on the ground, said apparatus comprising:

curvilinear flexible arch means dimensioned to have attached thereto a part of the periphery of the open end of the collapsible container, said arch means having generally opposing end portions;

securing means for securing said part of the periphery of the open end of the collapsible container to said arch means; and base means for pressing the part of the periphery of the open end of the collapsible container extending directly between the end portions of said arch means against the ground, said base means including a plurality of spaced holes for selectively receiving said end portions to position said arch means in a generally vertical plane relative to the ground, wherein the holes selected for receiving said end portions establish the shape of said arch means; and a plurality of slits generally perpendicular to the plane of said arch means, for receiving portions of the part of the periphery of the container extending directly between the end portions of said arch means.

4. Apparatus for holding open in a generally vertical position the mouth of an open-ended collapsible container horizontally disposed on the ground, said apparatus comprising:

curvilinear, flexible arch means dimensioned to have attached thereto a part of the periphery of the open end of the collapsible container, said arch means having generally opposing end portions;

securing means for securing said part of the periphery of the open end of the collapsible container to said arch means; and base means for pressing the part of the periphery of the open end of the collapsible container extending directly between the end portions of said arch means against the ground, said base means comprising a plurality of juxtaposed sections moveable relative to each other, and each of said sections having a hole for receiving one of said end portions to position said arch means in a generally vertical plane relative to the ground, wherein the relative positions of said sections determines the distance between said holes and shape of said arch means, and wherein at least one of said sections includes a treaded surface for engaging the ground to resist the sliding of said apparatus on the ground.

* * * * *